US007124543B2

(12) United States Patent
Chubb

(10) Patent No.: US 7,124,543 B2
(45) Date of Patent: Oct. 24, 2006

(54) WINDOW FRAME

(75) Inventor: Richard A. Chubb, Voorhees, NJ (US)

(73) Assignee: Thermoseal Industries, L.L.C., Gloucester, NJ (US)

( * ) Notice: Subject to any disclaimer, the term of this patent is extended or adjusted under 35 U.S.C. 154(b) by 565 days.

(21) Appl. No.: 10/236,087

(22) Filed: Sep. 6, 2002

(65) Prior Publication Data

US 2003/0046887 A1 Mar. 13, 2003

Related U.S. Application Data

(60) Provisional application No. 60/317,681, filed on Sep. 6, 2001.

(51) Int. Cl.
*E06B 7/00* (2006.01)
*E06B 1/04* (2006.01)

(52) U.S. Cl. ..... 52/212; 52/204.597; 52/656.5; 52/455; 49/504

(58) Field of Classification Search ..... 52/212–213, 52/204.53, 204.597, 204.62, 783.1, 784.1, 52/656.5, 455–457; 49/504, 453
See application file for complete search history.

(56) References Cited

U.S. PATENT DOCUMENTS 3,641,721 A * 2/1972 Martin ..... 52/212
3,750,358 A * 8/1973 Lewkowitz ..... 52/204.597
4,525,966 A * 7/1985 Litchfield et al. ..... 52/204.591
4,996,814 A * 3/1991 Guillemet ..... 52/656.5
4,999,958 A * 3/1991 Harrison ..... 52/214
5,577,355 A * 11/1996 Leonelli ..... 52/204.62
5,692,349 A * 12/1997 Guillemet ..... 52/204.53
5,941,033 A * 8/1999 Adams ..... 52/212

FOREIGN PATENT DOCUMENTS

FR 2571091 * 4/1986

* cited by examiner

*Primary Examiner*—Winnie Yip
(74) *Attorney, Agent, or Firm*—Francis C. Hand; Carella, Byrne, Bain eta

(57) ABSTRACT

The window frame is entirely made of plastic and has a glazing frame to be mounted in an opening of a door and a panel frame for fitting on the glazing frame from an opposite side of the door. The frames are made of extruded plastic elements and sandwich a window frame therebetween. The elements of the glazing frame have a lip for receiving the elements of the panel frame in slide friction-fit manner. A dual durometer bead is disposed between the interfitted elements for sealing purposes. Glazing beads are also mounted in an extruded element of the glazing frame to hold a window unit in place.

19 Claims, 2 Drawing Sheets

WINDOW FRAME

This application claims priority of Provisional Application No. 60/317,681, filed Sep. 6, 2001.

This invention relates to a window frame for a door, a wall of a refrigerated room or cabinet or the like. The window frame can also be used in walls of refrigerated meat packing plants, cold storage facilities, and the like.

As is known, doors to refrigerated rooms are frequently provided with windows so that a person may view the interior of the refrigerated unit. Generally, these windows are insulated in order to reduce heat transfer from an outside environment into the refrigerated unit. Also, it has been known to heat the windows via heated glass or perimeter heater wires to avoid a build-up of condensation on the exterior surface of the window. In some cases (e.g., environmental test chambers), the interior surface of the window is subject to condensation or frost formation as well. Heated glass and/or perimeter heater wires is of assistance in these situations as well.

In the past, window units made of metal parts have been secured in the refrigerated doors, for example by means of bolts or screws. However, being made of metal, such windows are good conductors of heat and provide an inlet for heat into the space to be refrigerated. Thus, they are extremely susceptible to condensation formation on the frame unless the frame itself is heated. Further, the use of bolts or screws requires the use of tools and alignment in order to properly place the windows in the door.

It is the object of this invention to provide a window frame of low heat conductance and a high R-value rating.

It is the object of this invention to provide a plastic window frame of relatively simple construction.

It is the object of this invention to provide a window frame which can be readily installed in an opening of a door or wall of a refrigerated unit.

Briefly, the invention provides for a window frame for a door which is comprised of two rectangular frames which can be fitted together from opposite sides of an opening in a door or wall of a refrigerated unit.

In accordance with the invention, a rectangular glazing frame of extruded plastic elements is provided for fitting into the opening of the door from one side and a rectangular panel frame of extruded plastic elements is provided for fitting on the glazing frame within the opening of the door by being inserted from the opposite side of the door.

The plastic elements of each frame are integrally welded to each other at the corners of the each frame to provide an integral unit. Technically, the plastic elements are fusion welded or thermally welded at the corners of the frame to create an integral frame. The nature of the weldment of each extruded plastic element to an adjacent plastic element is such that no other elements, particularly metal elements, such as corner keys or chevron stiffeners, screws and other fasteners, are required in order to connect the elements together or to reinforce the formed connection. Thus, the completed frame is of relatively light weight and of rigid construction.

The elements of the glazing frame are also provided with two flanges, one of which extends outwardly to abut one side of a door and the other which extends inwardly for abutting and retaining a window unit received within the glazing frame.

The plastic elements of the panel frame have a single flange which extends outwardly to abut an opposite side of the door.

The two frames are shaped and constructed such that the rectangular panel frame slides over a stepped portion of the glazing frame in a friction fit manner.

The window frame also has a plurality of plastic glazing beads, each of which is removably mounted in a respective element of the glazing frame for holding a window unit within the glazing frame. In addition, each glazing bead has a longitudinally disposed dual durometer seal or bead for sealingly engaging a window unit disposed in the glazing frame. In like manner, each element of the glazing frame has a longitudinally disposed dual durometer seal or bead for sealingly engaging a window unit disposed in the glazing frame on a side opposite a glazing bead. The dual durometer beads help create a moisture-proof or moisture-resistant seals which serve to prevent moisture or water from getting down to the sealant that creates a hermetic seal on the window unit. Moisture in contact with the sealant is the predominant cause of failure for any window unit, so it is important to prevent this from happening. The dual durometer seal can be eliminated by using silicone or similar bedding compound around the frame-to-glass interface, but this is a costly and labor-intensive method.

Typically, the window unit is a standard insulated type. For example, the window unit may have two or three or more spaced apart panes of glass sealingly secured within a frame to form a window unit. Such a unit may be readily inserted into the glazing frame and secured in place by the glazing beads.

These and other objects and advantages of the invention will become more apparent from the following detailed description taken in conjunction with the accompanying drawings wherein.

Figure 1:
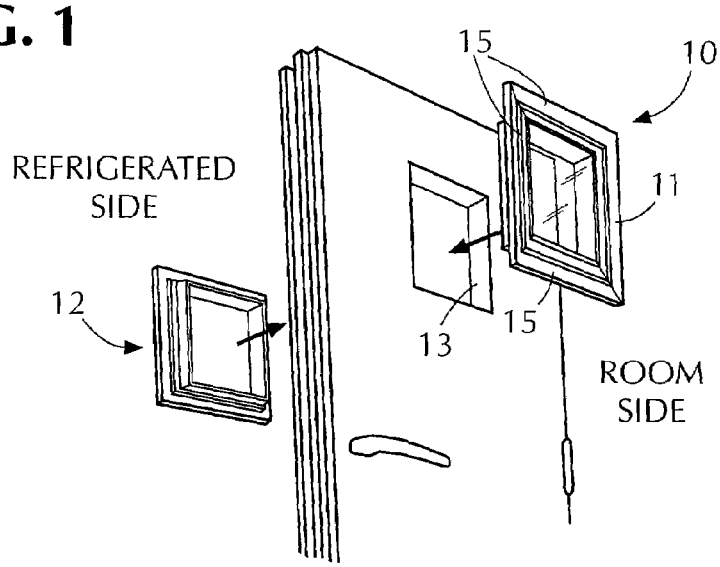
FIG. 1 illustrates a perspective exploded view of a window frame and door in accordance with the invention.

Referring to FIG. 1, the window frame 10 is formed of two frames, 11, 12 for fitting into an opening 13 in a door 14 or wall 14*a* for a refrigerated unit.

One frame 11 functions as a glazing frame and is of rectangular shape to fit into the rectangular opening 13. This rectangular frame 11 is formed solely of four straight extruded plastic elements 15.

Figure 2:
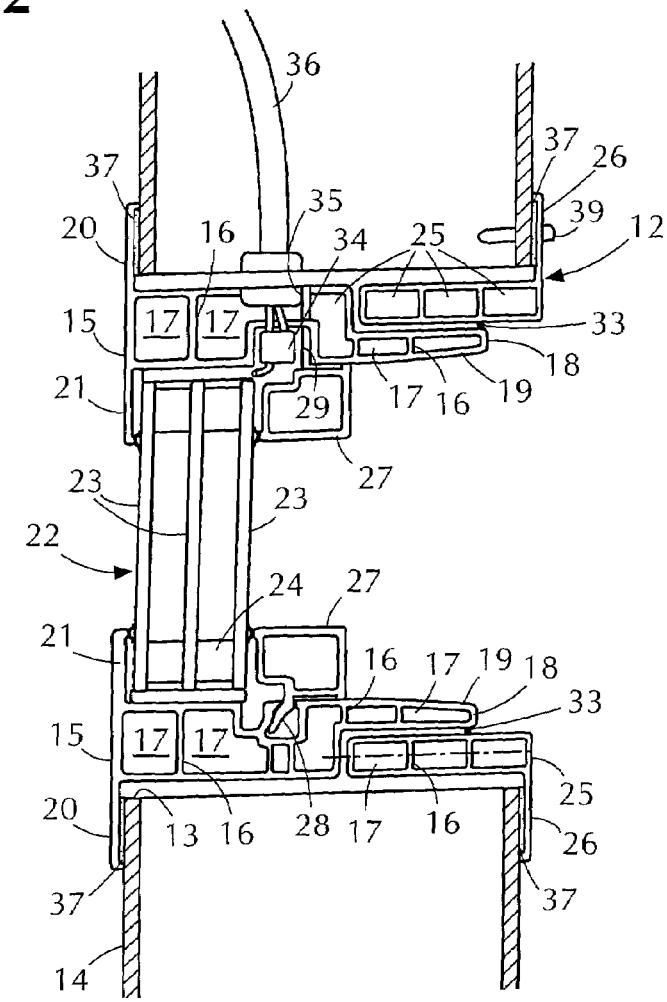
FIG. 2 illustrates a side cross-sectional view of a window frame with a window unit therein in accordance with the invention.

As illustrated in FIG. 2, each element 15 has a skeletal cross-section with internal ribs 16 to define hollow spaces 17 therebetween. Each element is made of a plastic, such as a rigid polyvinyl chloride (PVC). The ribs and hollows in the extrusion are required in order to create structural strength and extrudability of the rigid PVC. They also lower weight and provide welding interfaces for joining the parts in a fusion welding process. Depending upon the size of the opening 13 in the door 14, the width of the glazing frame 11 may be greater or less than as illustrated.

Each element 15 also has a lip 18 of hollow construction that extends into the door 14 for receiving the panel frame 12 thereon in slide friction fit (interference fit) relation. As shown, the lip 18 includes a sloped surface 19 facing the interior of the glazing frame 11 that is disposed to help shed water, and the like, that may occur during operation or cleaning on the inside surface. The "interference fit" is accomplished via another "dual durometer bead" 33 that helps minimize the gap, and prevent moisture or dirt or bacteria-harboring material from getting in the joint between the two panels.

Each element 15 of the glazing frame 11 has a flange 20 that extends outwardly to abut one side of the door 14 and a second flange 21 that extends inwardly for abutting a window unit 22 received within the glazing frame 11. As shown, the flanges 20, 21 are flat and coplanar with each other.

As illustrated in FIG. 2, the window unit 22 is made of three panes 23 of glass which are mounted in sealed relation and in spaced apart relation to each other within a frame 24. The window unit may also be a single pane or other multi-pane unit, may be made with heated glass, may include perimeter heat, and the like. The window unit 22 is otherwise of conventional structure and need not be further described.

The panel frame 12 is constructed solely of four extruded plastic elements 25. Each of these plastic elements 25 is integrally welded to an adjacent plastic element 25 to form a corner of the panel frame 12. Also, each element 25 has an outwardly extending flange 26 to abut an opposite side of the door 14.

Figure 3:
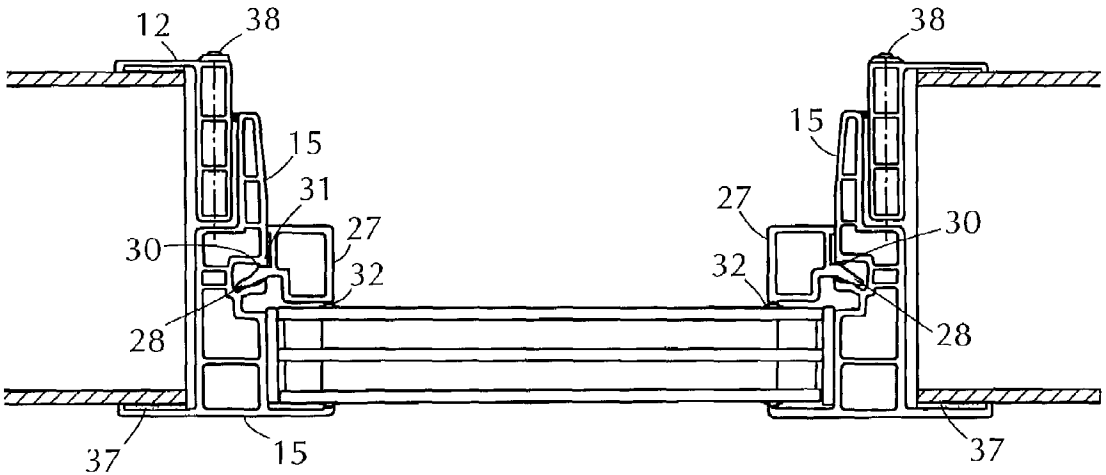
FIG. 3 illustrates a top cross-sectional view of a window frame of FIG. 2.

The window frame 10 also has a plurality of plastic glazing beads 27. Each glazing bead 27 is removably mounted in an extruded element 15 of the glazing frame 11. As illustrated in FIG. 2, each glazing bead 27 is hollow and has a generally rectangular cross-section although any suitable cross-sectional shape may be used. In addition, a flange 28 extends outwardly from each glazing bead 27 for fitting within a recess 29 of an element 15 of the glazing frame 11. As illustrated in FIG. 3, each flange 28 has a projection 30 thereon which engages a lip 31 formed on an element 15 of the glazing panel 11 along the mouth of the recess 29 so as to removably lock the bead 27 between the window unit 22 and glazing panel 15.

Figure 4:
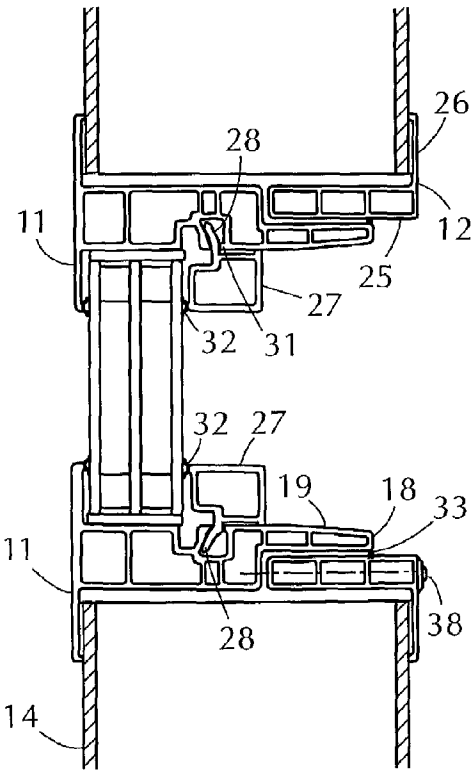
FIG. 4 illustrates a side cross-sectional view similar to FIG. 2 at a point spaced from a heater unit within the glazing frame.

As shown in FIGS. 3 and 4, each glazing bead 27 has a longitudinally disposed bifurcated seal 32 for sealingly engaging the window unit 22 disposed in the glazing frame 11.

The four glazing beads 27 are fitted into the glazing frame 15 such that two glazing beads 27 extend along the interior width of the glazing frame 15 while the remaining two glazing beads 27 fit into parallel relation between the first two glazing beads 27. All four beads could be the same length, and they could be butted end-to-end.

As illustrated in FIG. 2, a sealing bead 33 is disposed between the glazing frame 11 and panel frame 12 for sealing purposes and to avoid any bacteria harboring "gaps" that are over 1/32 inch (0.030 inches).

As is conventional, as indicated in FIG. 2, the glazing panel 11 is provided with a heater 34 for heating the window unit 22 to avoid condensation on the window pane 23 facing the refrigerated side of the door 14 and an opening 35 is also provided in the glazing panel 11 for passage of a power cord 36 to the heater 34. The heater 34 is only needed in freezer-type refrigerated applications, or in refrigerated applications where the exterior environmental conditions are conducive to condensation formation (e.g., high temp/high humidity situations, with relatively cold interior temperatures) and may otherwise be eliminated.

Referring to FIGS. 2 and 3, a suitable glazing tape 37 is provided between the outer flanges 20,26 of the panels 11, 12 for abutting the door 14.

In order to install the window frame 10 and the door 14, the glazing frame 11 is pressed into the opening 13 in the door 14 until the outer flanges 20 abuts against the door 14. The flanges 20 are then pressed against the door to ensure that the glazing tape 37 thereon bonds properly to the door completely around the frame 11.

Next, the panel frame 12 is pressed into the opening 13 from the opposite side of the door 14 until the flanges 26 abut the door 14 as indicated in FIG. 2. During this time, the panel frame 12 slides onto the peripheral lip 18 of the glazing frame 11. Again, the flanges 26 of the panel frame 12 are pressed against the door 14 to ensure bonding of the glazing tape 37 thereon to the door 14.

If desired, one or more assembly screws 38 (see FIG. 3) may be passed through the panel frame 12 into the glazing frame 11 to secure the two frames 11, 12 together. Likewise, an assembly screw 39 (see FIG. 2) may be passed through the flange 26 of the panel frame 12 into the door 14 to affixedly secure the panel frame 12 to the door 14. Alternatively, screws (not shown) can be installed perpendicular to the "sloped surface" 19 of the glazing frame 11. This is a relatively means for ensuring that the two frames 11,12 do not separate, and can be accomplished with 2, 4, 6, or 8 small stainless steel self-tapping sheet metal screws that are pre-painted gray to match the color of the extruded elements 15. This is far less complicated than trying to drill through the panel frame 12 and intersect the glazing frame 11 at just the right spot.

One advantage of this tape application is that it is entirely feasible for this to be a one-person installation. Also, the screws are not necessarily required, so that this could be called a fastener-less installation.

The window frame is made entirely of plastic material, such as, rigid PVC. As such, the window frame is light in weight as compared to metal frames, has a high R value and allows for the use of vinyl welding technology, i.e. jointless seams.

Further, the two frames are made solely of extruded plastic elements that are welded together without need for connecting parts, screws or the like.

The invention thus provides a window frame that virtually eliminates a need for a perimeter heater wire to prevent condensation and that has a high R-value material (low coefficient of thermal conductivity [K-Value]).

The invention also provides a window frame that requires only a simple installation, potentially a one-man operation, with virtually no custom-fitting required on the job site. Also, the glass is field replaceable. That is, should the glass break or fail the window unit can be deglazed [removed] and a new unit can be easily "dropped-in".

The window frame is adjustable for various wall thicknesses, as determined by the panel frame design and geometry, i.e. varying width panel frames can be provided to accommodate varying wall thicknesses, and, a single panel frame is flexible enough to accommodate nearly an inch of wall thickness variability. Further, the window frame can accommodate virtually any size opening, or geometry, provided the opening is rectangular. Still further, the window frame does not require any field-applied sealants to secure the system or seal the frame to the wall panels or door panels into which it is placed.

What is claimed is:

1. A window frame for a door comprising a glazing frame of extruded plastic elements, each said element having a first outwardly directed flange to abut one side of a door, a second flange and a stepped portion extending therefrom; and a panel frame of extruded plastic elements, each said element of said panel frame having an outwardly directed flange to abut an opposite side of the door and being slidably mounted on said stepped portion of a respective element of said glazing frame in friction fit manner.

2. A window frame as set forth in claim 1 which further comprises a window unit abutted against said second flange of each respective element of said glazing frame.

3. A window frame as set forth in claim 2 which further comprises a plurality of plastic glazing beads, each said bead being removably mounted in a respective extruded element of said glazing frame for holding said window unit between said second flange of each extruded element of said glazing frame and said bead.

4. A window frame as set forth in claim 3 wherein each extruded element of said glazing frame includes a recess and each glazing bead includes an outwardly extending flange fitting within said recess of a respective extruded element of said glazing frame.

5. A window frame as set forth in claim 4 wherein each recess has a lip and each flange of a respective glazing bead has a projection engaging said respective lip to removably lock said glazing bead between said window unit and said glazing frame.

6. A window frame as set forth in claim 2 wherein each glazing bead has a bifurcated seal sealingly engaging said window unit.

7. A window frame as set forth in claim 1 which further comprises a sealing bead between said stepped portion of each said element of said glazing frame and each said element of said panel frame.

8. A window frame as set forth in claim 1 wherein each element is of skelatal cross-section.

9. A window frame as set forth in claim 1 which further comprises a glazing tape on said first flange for abutting a door.

10. A window frame as set forth in claim 1 wherein said glazing frame is rectangular and said panel frame is rectangular.

11. A window frame as set forth in claim 1 wherein said second flange of said glazing frame is coplanar with said first flange of said glazing frame.

12. A window frame for a door comprising a glazing frame consisting of extruded plastic elements, each said element having a first outwardly directed flange to abut one side of a door, a second flange and a stepped portion extending therefrom;

a panel frame of consisting of extruded plastic elements, each said element of said panel frame having an outwardly directed flange to abut an opposite side of the door and being slidably mounted on said stepped portion of a respective element of said glazing frame in friction fit manner;

a window frame abutted against said second flange of each respective element of said glazing frame; and a plurality of plastic glazing beads, each said bead being removably mounted in a respective extruded element of said glazing frame for holding said window frame between said second flange of each extruded element of said glazing frame and said bead.

13. A window frame as set forth in claim 12 wherein each extruded element of said glazing panel includes a recess and each glazing bead includes an outwardly extending flange fitting within said recess of a respective extruded element of said glazing frame.

14. A window frame as set forth in claim 13 wherein each recess has a lip and each flange of a respective glazing bead has a projection engaging said respective lip to removably lock said glazing bead between said window frame and said glazing panel.

15. A window frame as set forth in claim 12 wherein each glazing bead has a bifurcated seal sealingly engaging said window frame.

16. A window frame as set forth in claim 12 which further comprises a sealing bead between said stepped portion of each said element of said glazing frame and each said element of said panel frame.

17. A window frame as set forth in claim 12 wherein each element is of skelatal cross-section.

18. A window frame as set forth in claim 12 which further comprises a glazing tape on said first flange for abutting a door.

19. A window frame as set forth in claim 12 wherein said second flange of said glazing frame is coplanar with said first flange of said glazing frame.

* * * * *

UNITED STATES PATENT AND TRADEMARK OFFICE

CERTIFICATE OF CORRECTION

PATENT NO. : 7,124,543 B2
APPLICATION NO. : 10/236087
DATED : October 24, 2006
INVENTOR(S) : Richard A. Chubb It is certified that error appears in the above-identified patent and that said Letters Patent is hereby corrected as shown below:

Column 2,
Line 14, delete "a"

Column 3,
Line 60, "and" should be -- in --

Column 4,
Line 19, "relatively means" should be -- relatively simple means --
Line 26, "tape" should be -- type --

Column 6,
Line 3, cancel "of"
Line 44, "extend ing" should be -- extending --
Line 52, "ing" should be -- ring --
Line 54, "a nd" should be --and --

Signed and Sealed this

Ninth Day of January, 2007

JON W. DUDAS
*Director of the United States Patent and Trademark Office*